US008823598B2

(12) United States Patent
Beausang

(10) Patent No.: US 8,823,598 B2
(45) Date of Patent: Sep. 2, 2014

(54) REFLECTOR AND A MULTI BAND ANTENNA

(75) Inventor: Michael Beausang, Bergshamra (SE)

(73) Assignee: Powerwave Technologies S.a.r.L., Luxembourg (LU)

( * ) Notice: Subject to any disclaimer, the term of this patent is extended or adjusted under 35 U.S.C. 154(b) by 305 days.

(21) Appl. No.: 13/454,951

(22) Filed: Apr. 24, 2012

(65) Prior Publication Data

US 2012/0280881 A1 Nov. 8, 2012

Related U.S. Application Data

(60) Provisional application No. 61/482,884, filed on May 5, 2011.

(51) Int. Cl.
*H01Q 21/00* (2006.01)

(52) U.S. Cl.
USPC ..... 343/817

(58) Field of Classification Search
USPC ..... 343/817, 912, 836–837
See application file for complete search history.

(56) References Cited

U.S. PATENT DOCUMENTS

| | | | | |
|---|---|---|---|---|
| 6,037,912 | A | 3/2000 | Demarre | |
| 6,756,948 | B2 * | 6/2004 | Love | 343/778 |
| 6,963,314 | B2 * | 11/2005 | Webb et al. | 343/844 |
| 7,197,800 | B2 * | 4/2007 | Sievenpiper et al. | 29/25.42 |
| 7,639,196 | B2 * | 12/2009 | Elliot et al. | 343/757 |
| 7,737,908 | B2 * | 6/2010 | Yanagi et al. | 343/846 |
| 8,643,559 | B2 * | 2/2014 | Deng et al. | 343/758 |
| 2008/0309568 | A1 | 12/2008 | Deng et al. | |

FOREIGN PATENT DOCUMENTS

| | | | |
|---|---|---|---|
| WO | 9743799 | A1 | 11/1997 |
| WO | 2011026034 | A2 | 3/2011 |

OTHER PUBLICATIONS

International-type Search Report dated Nov. 4, 2011 from Application No. SE1150396-8.

* cited by examiner

*Primary Examiner* — Huedung Mancuso
(74) *Attorney, Agent, or Firm* — OC Patent Law Group; David L. Henty

(57) ABSTRACT

The present invention relates to a reflector for an antenna comprising a first reflector assembly and at least one second reflector assembly, the first reflector assembly having a first reflector structure adapted for a first antenna frequency band $f_1$ and at least one second antenna frequency band $f_2$; the at least one second reflector assembly having a second reflector structure adapted for the first antenna frequency band $f_1$ and at least one third antenna frequency band $f_3$; and wherein the first reflector assembly and the at least one second reflector assembly are electrically coupled so that the first reflector assembly and the at least one second reflector assembly together form a common reflector structure adapted for the first $f_1$, at least one second $f_2$ and at least one third $f_3$ antenna frequency bands. Furthermore, the invention also relates to a multi band antenna comprising at least one such reflector.

31 Claims, 12 Drawing Sheets

REFLECTOR AND A MULTI BAND ANTENNA

RELATED APPLICATION INFORMATION

The present application claims the benefit under 35 USC 119(e) of provisional patent application Ser. No. 61/482,884, filed May 5, 2011, the disclosure of which is incorporated herein by reference in its entirety.

TECHNICAL FIELD

The present invention relates to a reflector, and a multi band antenna comprising at least one such reflector.

BACKGROUND OF THE INVENTION

Multi band antennas are antennas providing wireless signals in multiple radio frequency bands, i.e. two or more bands. They are commonly used and are well known in wireless communication systems, such as GSM, GPRS, EDGE, UMTS, LTE, and WiMax systems.

This type of multi band antenna often comprises a reflector structure for controlling the radiation of the antenna, e.g. beam width and lobe pattern. To achieve this end, mentioned types of reflectors may have different shapes and setups depending on the frequency in use and the desired radiation pattern, etc.

FIG. 1 schematically shows, in cross section, an example of a reflector for a triple band base station antenna according to prior art. The reflector is placed behind one or more radiating antenna elements in use and is arranged to provide, together with the radiating elements, desired antenna radiation characteristics.

However, it has proved difficult to provide reflectors having reflector structures suitable for multiple antenna frequency bands giving desired antenna radiation characteristics. This is especially the case for multi band antennas arranged to transmit in three or more frequency bands.

SUMMARY OF THE INVENTION

Therefore, an object of the present invention is to provide a reflector which fully or in part mitigates and/or solves the drawbacks of prior art reflectors and antennas. More specifically, the object of the present invention is to provide a reflector having good radiation control and/or characteristic for multiband antennas.

Another object of the invention is to provide a reflector having good radiation control for multiband antennas arranged to transmit in three or more antenna frequency bands. Yet another object if the invention is to provide an alternative reflector and multiband antenna.

According to one aspect of the invention, the mentioned objects are achieved with a reflector for an antenna comprising a first reflector assembly and at least one second reflector assembly, the first reflector assembly having a first reflector structure adapted for a first antenna frequency band $f_1$ and at least one second antenna frequency band $f_2$; the at least one second reflector assembly having a second reflector structure adapted for said first antenna frequency band $f_1$ and at least one third antenna frequency band $f_3$; and wherein the first reflector assembly and the at least one second reflector assembly are electrically coupled so that the first reflector assembly and the at least one second reflector assembly together form a common reflector structure adapted for said first $f_1$, at least one second $f_2$ and at least one third $f_3$antenna frequency bands.

Furthermore, the present invention also relates to a multi band antenna comprising at least one reflector according to the invention.

The present invention provides a reflector having good radiation control for multiband antennas. This is especially the case for multi band antennas transmitting in multiple antenna frequency bands where the frequency bands are considerably spaced apart in the frequency range.

Another advantage of the invention is that a large and/or complex reflector structure for multiple bands can be assembled with two or more reflector assembly parts having simple structure, thereby simplify and reducing cost when manufacturing such reflectors, and make transportation easier of these reflectors. This also implies that a high degree of freedom is at disposal for the antenna designer when designing reflectors since the designer can combine different simple reflector structures to obtain a common (complex) reflector structure.

Further advantageous and applications of the present invention can be found in the following detailed description of the present invention.

BRIEF DESCRIPTION OF THE DRAWINGS

The appended drawings are intended to clarify and explain different embodiments of the present invention in which.

DETAILED DESCRIPTION OF THE INVENTION

Figure 1:
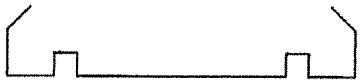
Fig. 1 (Prior Art)
FIG. 1 shows, in cross section, a reflector for a triple band antenna according to prior art.

To achieve aforementioned and further objectives, the present invention relates to a reflector for an antenna, and preferably to a reflector for a multi band antenna adapted for wireless communication systems.

The reflector according to the present invention comprises a first reflector assembly 1 and at least one second reflector assembly 2. The first reflector assembly 1 has a first reflector structure adapted for a first antenna frequency band $f_1$ and at least one second antenna frequency band $f_2$, and the second reflector assembly 2 has a second reflector structure adapted for the first antenna frequency band $f_1$ and at least one third antenna frequency band $f_3$.

The first 1 and second reflector 2 assemblies are electrically coupled to each other so that they together form a common reflector structure R adapted for the first $f_1$, second $f_2$ and third $f_3$ antenna frequency bands. Thus, the first 1 and second 2 reflector assemblies have a reflector structure adapted for at least one common antenna frequency band, in this case the first $f_1$ antenna frequency band.

It should therefore be realised that a reflector R according to the invention may comprise more than two reflector assemblies. However, two or more reflector assemblies making up the common reflector R should each have a reflector structure adapted for a least one common antenna frequency band $f_C$.

Generally, a reflector structure adapted for a specific antenna frequency band should in this disclosure mean that the reflector structure is so arranged that a transmit antenna having such a reflector fulfils one or more of the requirements of different reflector parameters known in the art. The reflector parameters are often specified for different applications and may concern horizontal beam width, front to back lobe ratio, cross polar discrimination, port to port tracking, etc. To achieve this, the reflector structure has a specific shape and may comprise shielding walls, baffles, corrugations and/or current traps, etc. for controlling radiation of the antenna. Typically, such parameters may be specified as: horizontal beam width (halfpower/−3 dB) 65 or 90 degrees; front to back lobe ratio 25-30 dB (+/−30 deg sector); cross polar discrimination 10-15 dB (worst case in +/−60 deg sector); port to port tracking <2 dB (worst case in +/−60 deg sector).

Figure 2:
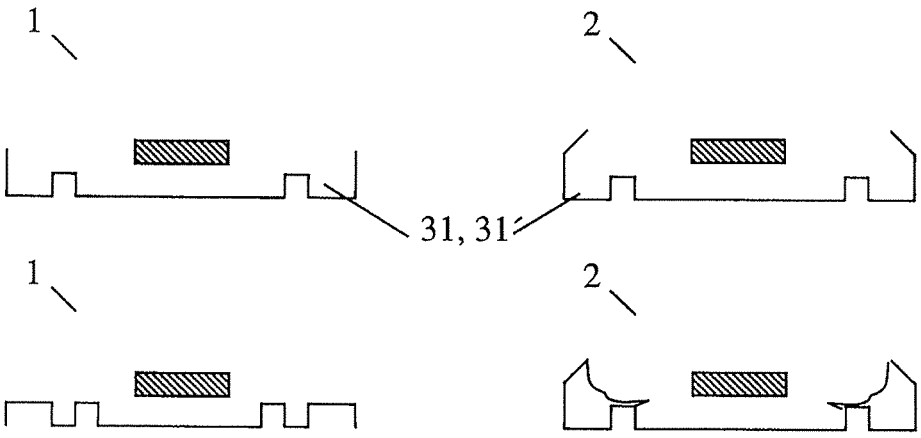
FIG. 2 shows, in cross section, first and second reflector assemblies of a common reflector structure according to the present invention.

FIG. 2 shows, in cross section, first 1 and second 2 reflector assemblies of a common reflector structure R according to the present invention. The first reflector assembly 1 is shown on the left hand side and the second reflector assembly 2 on the left hand side in FIG. 2. The dashed rectangles illustrate different antenna elements, and the upper and lower drawings in FIG. 2 represent cross sections at different antenna elements arranged for emitting in different frequency bands. It should be noted that the first 1 and second 2 reflector assemblies has different shapes, and from FIG. 2 it is evident that they have different cross-section shapes. The different shapes are due to the fact that the first 1 and second 2 reflector assemblies are adapted for at least one different antenna frequency band.

Figure 3:
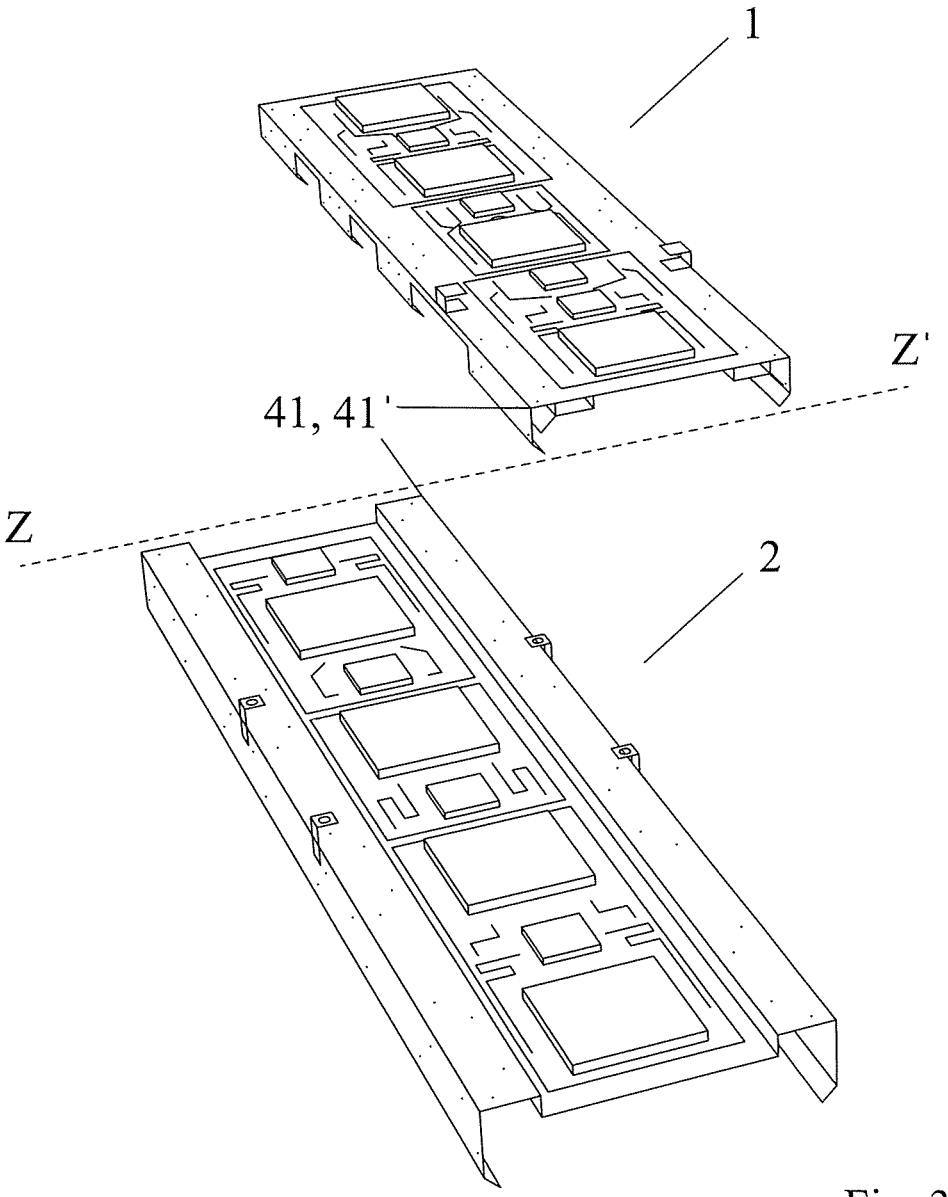
FIG. 3 shows a backside perspective view of the first and second reflector assemblies when not connected to each other.

FIG. 3 shows a partially exploding view of back side of the first 1 and second 2 reflector assemblies with PCB etchings and antenna elements. On each reflector assembly 1, 2, the antenna elements corresponding with the bigger shielding cage is operating in two frequency bands simultaneously; i.e. frequency band $f_1$ and $f_3$ for the first reflector 1, and $f_1$ and $f_2$ for the second reflector 2. The antenna elements corresponding to the smaller shielding cage is operating in one frequency band each: $f_3$ for the first reflector 1 and $f_2$ for the second reflector 2. Corresponding ends 41, 41' of the first 1 and second 2 reflector assemblies, which are connected in use, is also shown in FIG. 3.

The first 1 and second 2 reflector assemblies are electrically coupled so that they together form a common reflector structure R so arranged that the common reflector structure R fulfils one or more of the above mentioned reflector parameters, e.g. provides a specific beam width characteristic or front to back lobe ratio, etc.

The electrical coupling may be an indirect coupling, such as a capacitive coupling, or a direct coupling. A capacitive coupling can be made by using a non-conductive adhesive, e.g. tape or glue, between the first and second reflector assemblies. A direct electrical coupling can be achieved by spot welding, anodizing and bolting or by using a conductive adhesive.

The mentioned antenna frequency bands are preferably different frequency bands, and within the bandwidth for wireless communication systems such as GSM, GPRS, EDGE, HSDPA, UMTS, LTE, WiMax.

According to an embodiment, the common reflector R is adapted for triple band antennas, wherein the centre frequencies (e.g. the carrier frequencies) for the three bands are within the interval of 790 to 960 MHz for the first antenna frequency band f1, the interval of 1710 to 2170 MHz for the second antenna frequency band $f_2$, and the interval of 2.3 to 2.7 GHz for the third antenna frequency band $f_3$, respectively. Preferably, the frequency bands f1, $f_2$, $f_3$ do not overlap each other according to an embodiment.

Moreover, base station antennas in mentioned wireless communication systems are often exposed to harsh environmental conditions, such as rain, snow, ice, heavy winds, etc. Hence, an important aspect when designing such antennas is the mechanical stiffness and robustness to withstand such conditions. The robustness of antennas depends more or less on the reflector design since the reflector is an important and integral part of the antenna construction. Accordingly, the first 1 and second 2 reflector assemblies are furthermore mechanically connected to each other according to another embodiment of the present invention.

Figure 4:
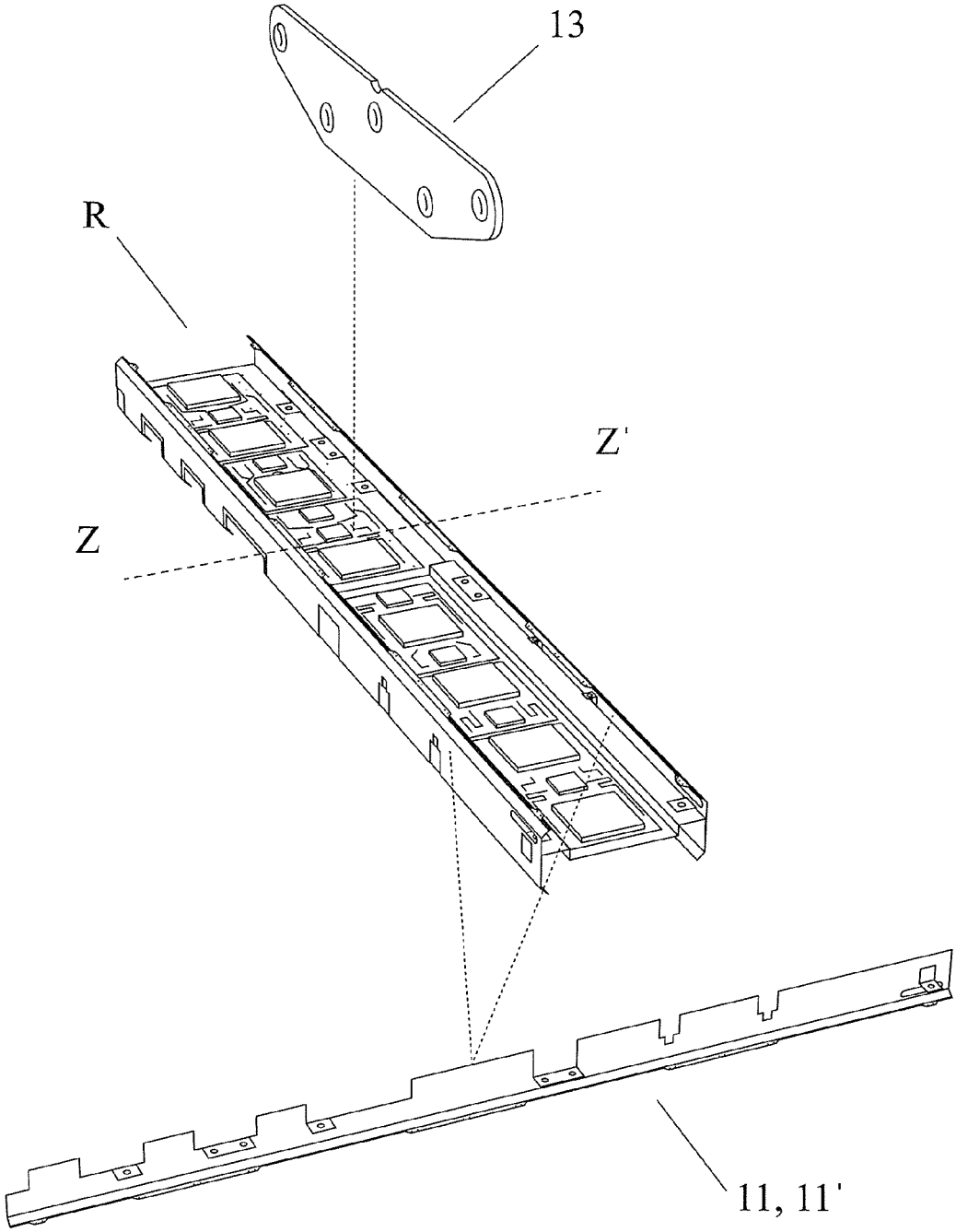
FIG. 4 shows a backside perspective view of an embodiment of an assembled common reflector structure/assembly according to the present invention.

FIG. 4 shows a backside perspective view of a reflector R according to the invention. The first 1 and second 2 reflector assemblies is in this embodiment electrically and mechanically connected to each other by means of a pair of support brackets 11, 11' and a connecting plate 13. It should be noted that the first 1 and second 2 reflector assemblies are connected to each other end-to-end in this embodiment, i.e. one end 41 of the first 1 reflector assembly is connected to a corresponding end 41' of the second 2 reflector assembly.

Each of the support brackets 11, 11' are mechanically connected to, and extends along each opposite side of the first 1 and second 2 reflector assemblies, respectively. The first 1 and second 2 reflector assemblies has in this embodiment an elongated flat shape and the same width.

Preferably, the first 1 and second 2 reflector assemblies are U-shaped in cross-section as shown in the figures. With this reflector design, each support bracket 11, 11' is L-shaped to fit the U-shape of the first 1 and second 2 reflector assemblies, thereby improving the stiffness and robustness of the reflector R construction further and also saving space. This embodiment is shown in FIG. 4.

To further improve electrical and/or mechanical coupling/connection between the first 1 and second reflector assemblies 2, one or more connector plates 13 may be provided to connect the two assemblies 1, 2. The connector plates 13 may be arranged on the front side and/or on the backside of the common reflector R, and extend over and being attached to both the first 1 and second 2 reflector assemblies so as to provide a robust reflector structure R.

Preferably, the first 1 and second 2 reflector assembly parts are made of aluminium, e.g. by folding aluminium sheet metal or by extrusion, but may be made of other suitable material. The different reflector parts, such as the first 1 and second 2 reflector assemblies, support brackets 11, 11', connector plates 13, and connecting elements 12 may be mechanically connected to each other by e.g. screwing, riveting, bolting, welding, etc, which provide a direct electrical coupling.

Figure 5:
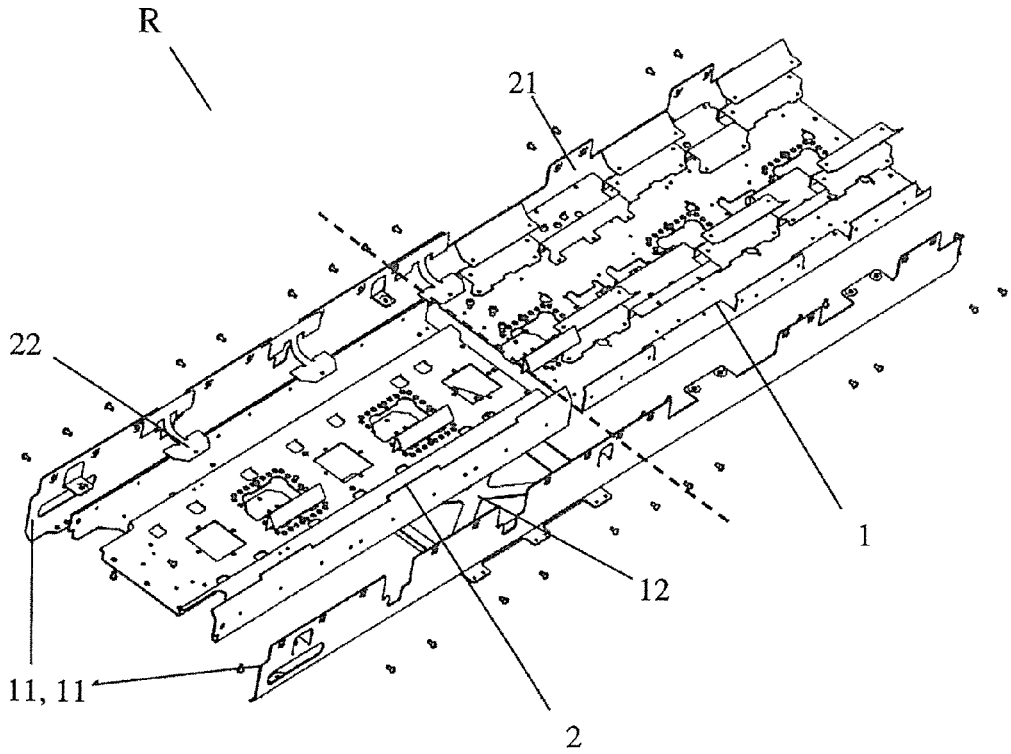
FIG. 5 shows a front side exploding view of an embodiment of a common reflector structure.

FIG. 5 shows a front side exploding view of an embodiment of a common reflector structure R.

To yet further improve the mechanical robustness and stiffness of the reflector R, one or more connecting elements 12 may be provided for electrically and mechanically connecting the support brackets 11, 11'. The connecting elements are preferably arranged on the back side of the reflector R so as not to influence the radiation of the antenna elements by being arranged in front of the antenna elements.

Figure 6:
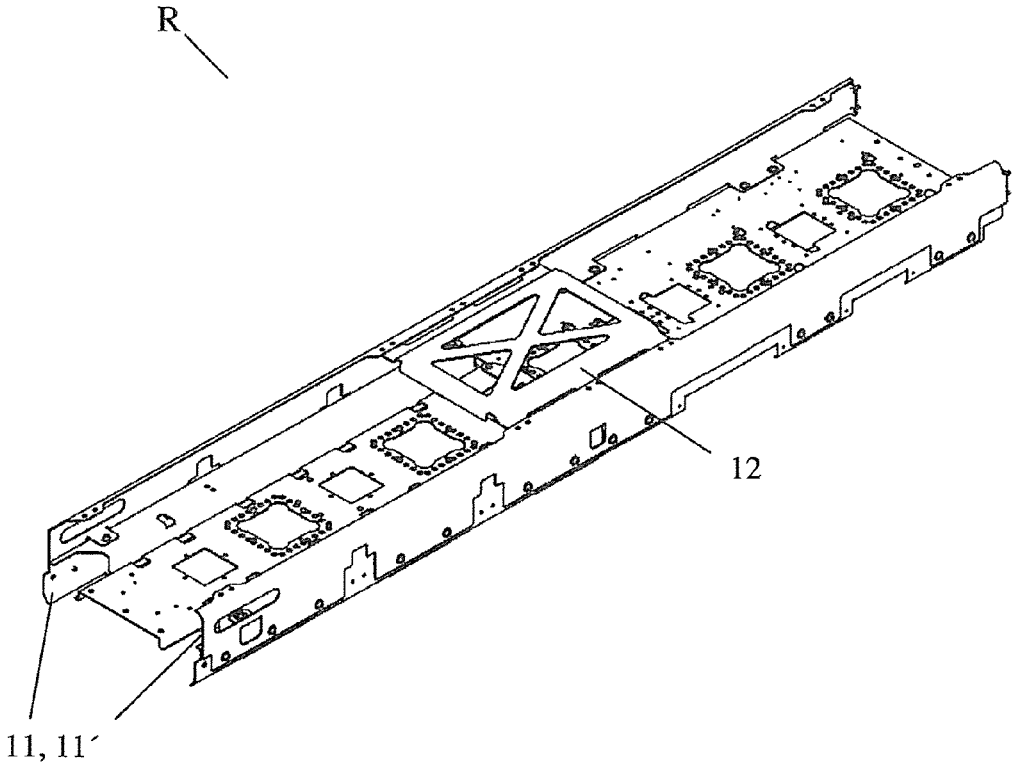
FIG. 6 shows a back side view of the embodiment in FIG. 5.
Figure 7:
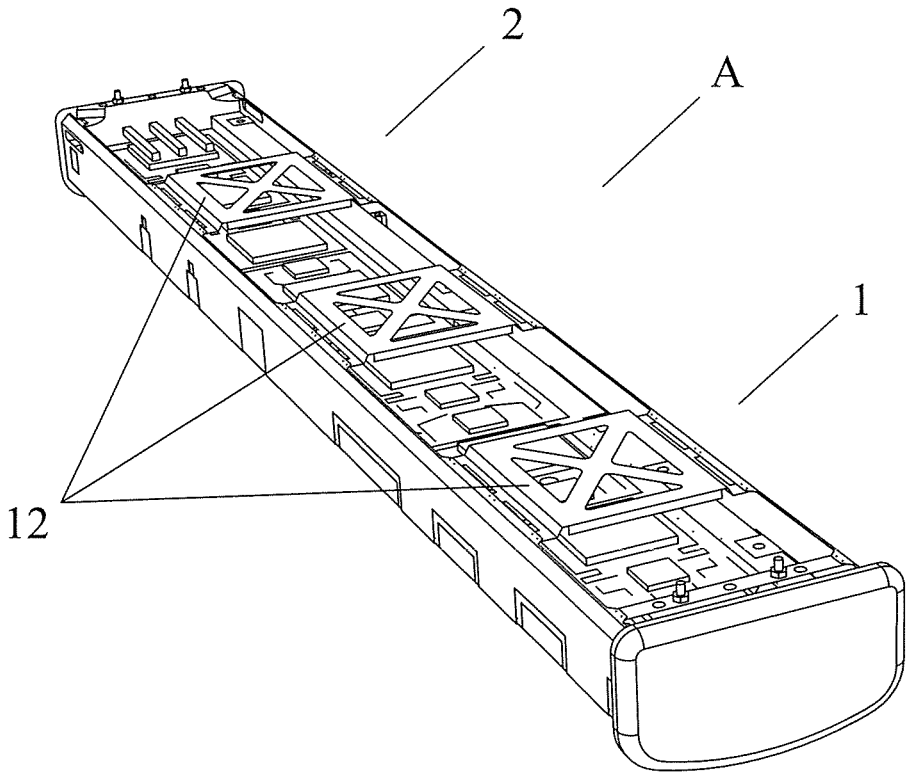
FIG. 7 shows a back side perspective view of an embodiment of a multi band antenna according to the present invention.
Figure 8:
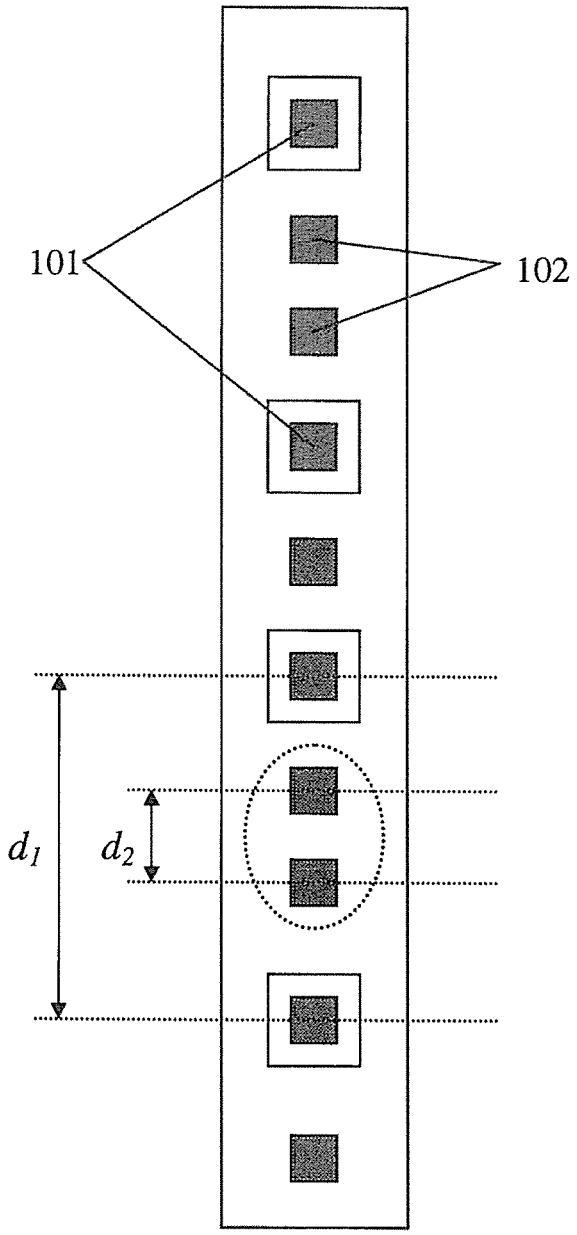
FIG. 8 shows an antenna array arrangement.

A rectangular connecting element 12 with a cross is shown in FIGS. 5 to 7. The cross shape improves the mechanical robustness of the reflector. The connecting element 12 in the figures has also four recesses to form the cross thereby reducing the overall weight of the reflector but still provide a robust construction.

It should also be noted that the first 1 and second 2 reflector assemblies according to yet another embodiment comprises at least one pair of symmetrically arranged partially enclosed cavities functioning as current traps 31, 31' for trapping surface currents on the reflector as shown in FIG. 2. In this respect, the cavities should be adapted to a quarter of the wave length of the frequency in use. The partially enclosed cavities preferably extend along the extension of the first 1 and second 2 reflector assemblies in a suitable manner.

The present invention further relates to a multi band antenna comprising at least one reflector R described above. FIG. 7 shows a triple band base station antenna A for wireless communication systems according to the invention, and FIGS. 8-11 show different antenna array arrangements for such a multi band antenna.

The antenna arrangement comprises a plurality of dual band 101 and single band 102 antenna elements. The dual band antenna elements 101 are adapted for transmitting/receiving in two different frequency bands. i.e. in a lower antenna RF band and a higher antenna RF band, while the single band antenna elements 102 are adapted for transmitting/receiving in the higher of the two mentioned RF bands. The antenna elements are arranged in a row/array as shown in FIGS. 8-11, and at least two single band elements 102 are arranged adjacent to each other. However, more than two single band elements 102 may be arranged adjacent to each other.

Two such single band antenna elements 102 are shown with a dotted circle in FIGS. 8-11. Thus, it means that at least two single band elements 102 are arranged next to each other without any other antenna elements placed between the two single band antenna elements 102 in the row/array. Hence, the dual band 101 and single band 102 antenna elements are irregularly arranged in the row and not alternately (or evenly) arranged. Thereby, the effective inter element spacing can be kept small enough over the antenna array in order to avoid unwanted grating lobes. Further, it will not be necessary to have more than one row/array (or column) of antenna elements, thus wide antenna designs may be avoided which saves space.

The antenna array arrangement allows smaller inter antenna element spacing, thereby avoiding undesirable grating lobes. This also means that the antenna design can be less bulky and smaller, resulting in slim and cost effective antenna array designs with reduced weight. The antenna array arrangement is especially suitable for antenna applications where there is a large spacing in the frequency range between the lower and higher frequencies.

An important aspect with the present antenna arrangement is that the inter antenna element spacing for both the lower antenna frequency band and the higher antenna frequency band is different, i.e. "non uniform spacing", over the antenna array in order to accommodate the different types of antenna elements in such a way that the effective element spacing (average spacing) over the array is such that undesired grating lobes are avoided in both bands. Other implications of the invention is that that electrical performance will be more consistent compared to other solutions, for example undesired effects where horizontal beam peak of the two frequency bands are different and distorted azimuth radiation patterns.

Figure 9:
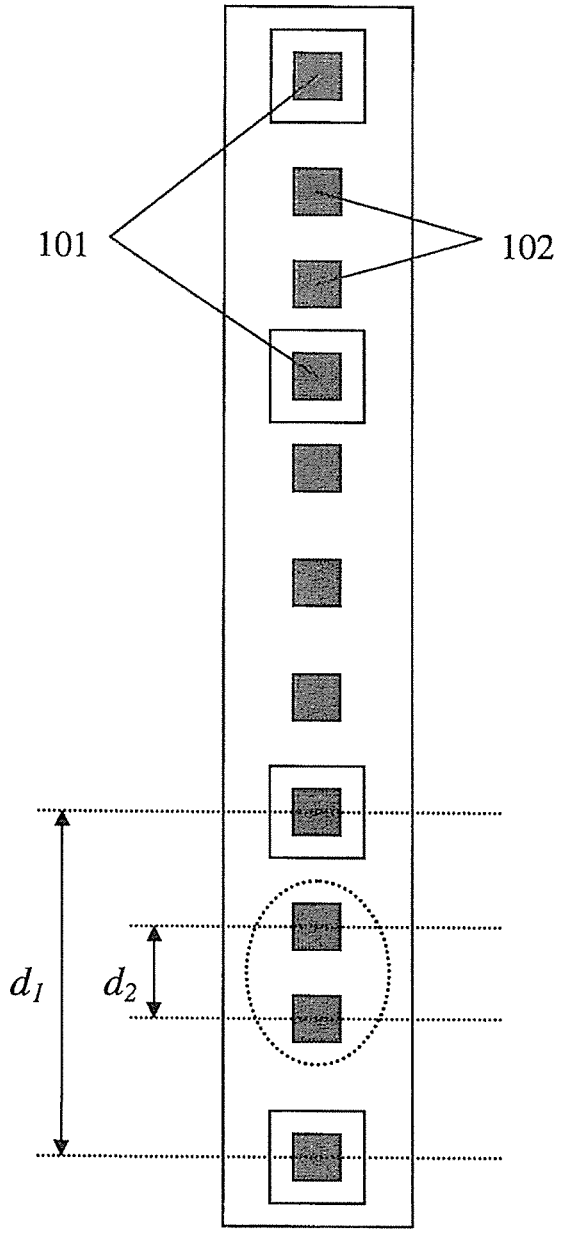
FIG. 9 shows another antenna array arrangement.

Moreover, the at least two single band antenna elements 102 may be arranged between two dual band antenna elements 101, which is also shown in FIG. 9. Preferably, the distance $d_2$ between the centres of the at least two single band antenna elements 102 is more than half the wavelength for the centre frequency of the higher antenna frequency band, and preferably between 0.6-0.9 times the wavelength for the centre frequency of the higher antenna frequency band.

Furthermore, the distance $d_2$ between the centres of the at least two first single band antenna elements 102 may be 0.6-0.8 times the wavelength for the centre frequency of the higher antenna frequency band and the distance between dual band antenna elements and single band antenna elements is 0.8-1.0 times the wavelength for the centre frequency of the higher antenna frequency band for good antenna performance.

Figure 10:
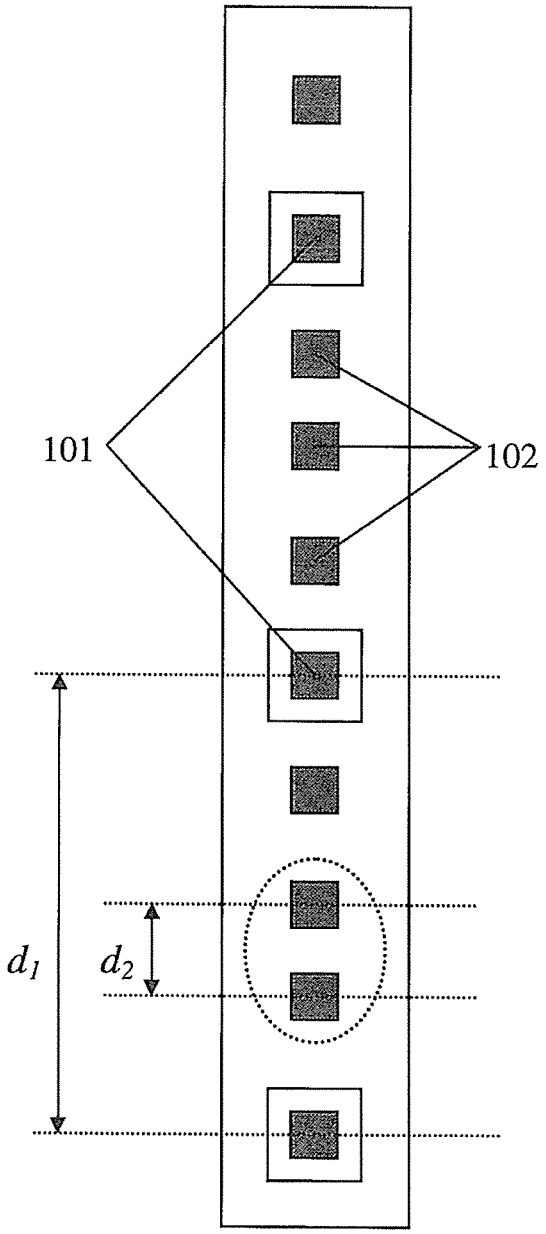
FIG. 10 shows another antenna array arrangement.
Figure 11:
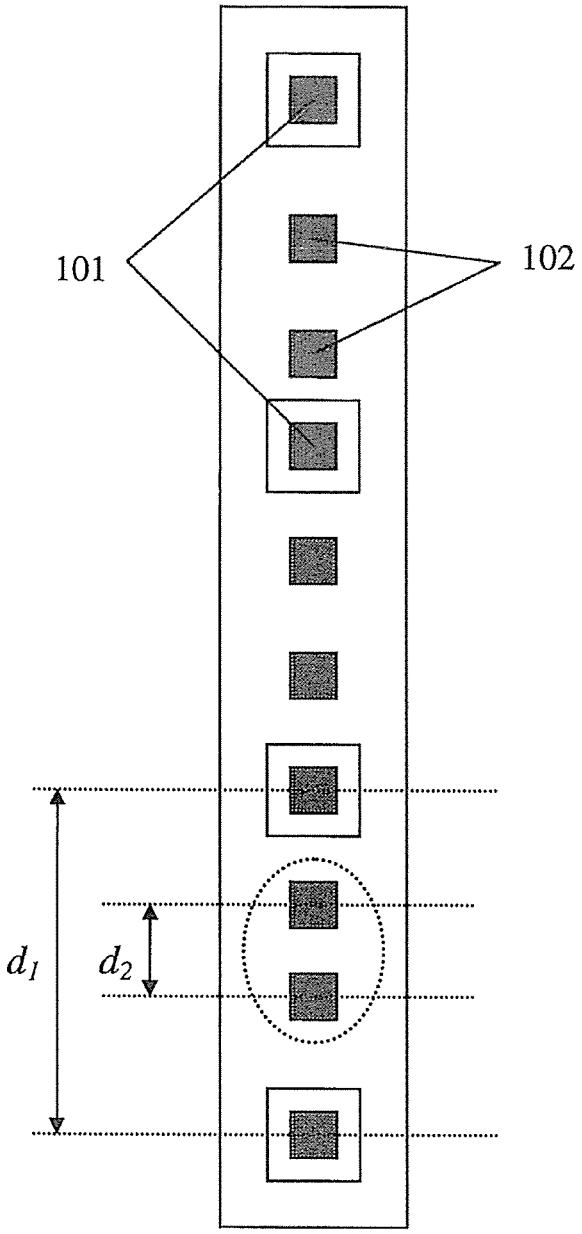
FIG. 11 shows another antenna array arrangement.

The centre frequency for the higher frequency band is preferably more than 2 times higher than the centre frequency band for the lower frequency band. More specifically, the centre frequencies for the first type dual band 101 and first type single band 102 antenna elements, i.e. the lower and higher frequency bands, may be within the interval of: 790 to 960 MHz and 2.3 to 2.7 GHz; 698 to 894 MHz and 2.3 to 2.7 GHz; 698 to 894 MHz and 3.6 to 3.8 GHz; or 790 to 960 MHz and 3.6 to 3.8 GHz, respectively. Hence, the ratio is around 2.86, 3.14, 4.65 and 4.22 in these exemplary cases. The number of single band antenna elements arranged between dual band antenna elements may be more than two, e.g. three or four. FIGS. 9-11 shows further examples of different inter antenna element spacing.

Figure 12:
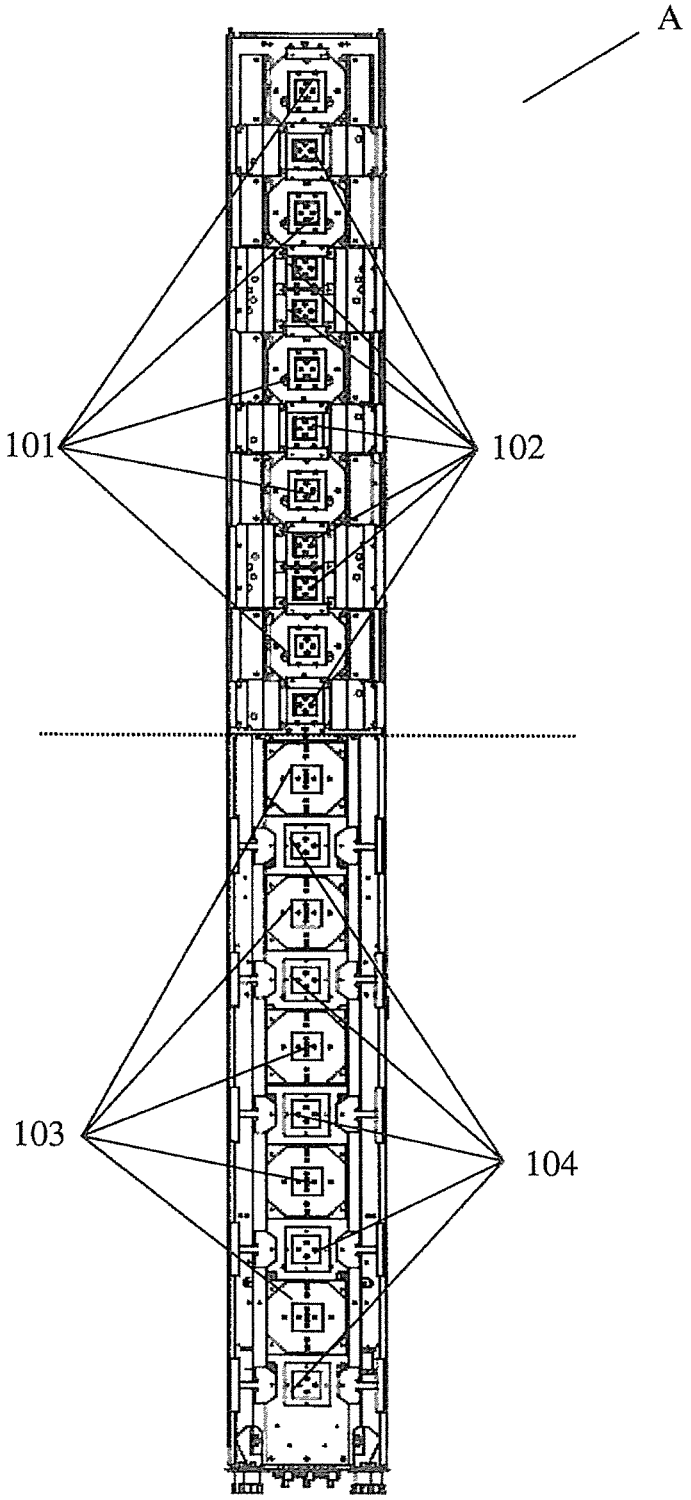
FIG. 12 shows, in view from above, an embodiment of the multi band antenna without a housing.
Figure 13:
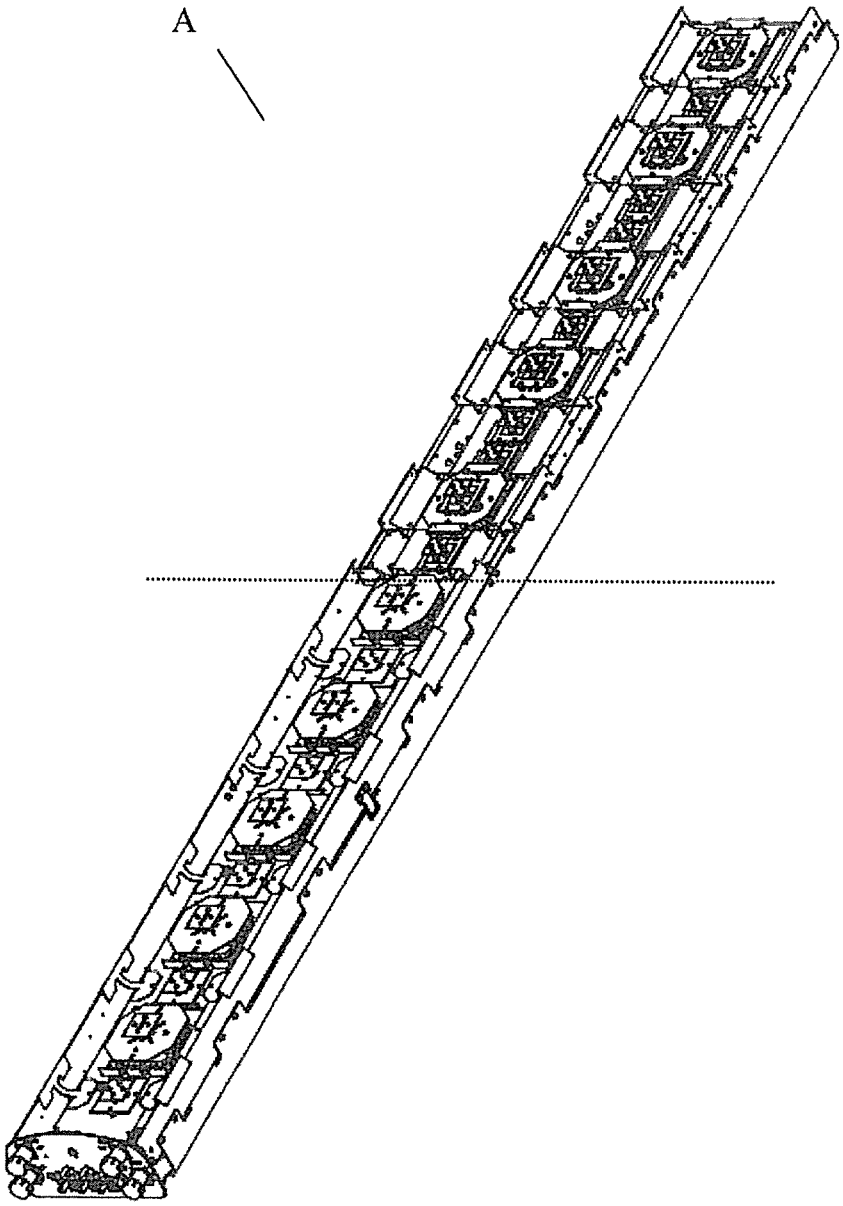
FIG. 13 shows the embodiment of the multi band antenna in FIG. 12 in perspective view.

FIG. 12 shows an embodiment of a triple band base station antenna according to the present invention without housing from above, and FIG. 13 shows the embodiment of FIG. 12 in a perspective view. As shown in these figures, the triple band antenna comprises two antenna parts having different antenna array element configurations, but together forming a single row/array of antenna elements. The dotted lines in FIGS. 12 and 13 illustrate where the two antenna (reflector) parts are electrically, and in this case also mechanically coupled/connected.

The arrangement in FIGS. 12 and 13 further comprises a plurality of second type of dual band antenna elements 103 and second type of single band 104 antenna elements which are alternately arranged with respect to each other so that every second antenna element is a second dual band 103 or a second single band 104 element as shown in the lower antenna part in FIGS. 12 and 13. The second type dual band antenna elements 103 are adapted for transmitting/receiving in two different frequency bands, i.e. in the lower RF band (the same lower frequency band as for the first type of dual band antenna elements 101) and in an intermediate RF band, while the second type single band antenna elements 104 are adapted for transmitting/receiving in the intermediate frequency band.

The centre frequencies for the first type dual band 101 and first type single band 102 antenna elements, i.e. the lower and higher frequency bands, are within the interval of 790 to 960 MHz, and 2.3 to 2.7 GHz, respectively; while the centre frequencies for the second dual band 103 and second single band 104 antenna elements, i.e. the lower and the intermediate frequency band, are within the interval of 790 to 960 MHz, and 1710 to 2170 MHz, respectively, so that a triple band antenna is formed. The antenna elements used may e.g. be patch antenna elements or dipoles, or any other suitable construction.

In this multi band antenna, the first type of dual band elements 101 and first type single band elements 102 are associated with the at least one second reflector assembly 2, and the second type of dual band elements 103 and second type of single band elements 104 are associated with the first reflector assembly 1, which means that the associated reflector assembly 1, 2 is the main reflector structure for shaping the radiation of a specific antenna element and is preferably arranged behind the specific antenna elements.

Those skilled in the art will also recognize that the described antenna array arrangement will not be dependent on the polarization of the antenna elements but will work for antennas with e.g. vertical polarization, circular polarization or dual +/−45 deg polarization.

Finally, it should be understood that the present invention is not limited to the embodiments described above, but also relates to and incorporates all embodiments within the scope of the appended independent claims.

What is claimed is:

1. A reflector for an antenna comprising a first reflector assembly and at least one second reflector assembly, said first reflector assembly having a first reflector structure adapted for a first antenna frequency band $f_1$ and at least one second antenna frequency band $f_2$;

said at least one second reflector assembly having a second reflector structure adapted for said first antenna frequency band $f_1$ and at least one third antenna frequency band $f_3$; and wherein said first reflector assembly and said at least one second reflector assembly are electrically coupled so that said first reflector assembly and said at least one second reflector assembly together form a common reflector structure adapted for said first $f_1$, at least one second $f_2$ and at least one third $f_3$ antenna frequency bands.

2. A reflector according to claim 1, wherein said first $f_1$, at least one second $f_2$ and at least one third $f_3$ antenna frequency bands do not overlap.

3. A reflector according to claim 1, wherein said first $f_1$, at least one second $f_2$ and at least one third $f_3$ antenna frequency bands are within the bandwidth for wireless communication systems such as GSM, GPRS, EDGE, HSDPA, UMTS, LTE, and WiMax.

4. A reflector according to claim 1, wherein:

said first antenna frequency band $f_1$ has a centre frequency within the interval of 790 to 960 MHz, said at least one second antenna frequency band $f_2$ has a centre frequency within the interval of 1710 to 2170 MHz, and said at least one third antenna frequency band $f_3$ has a centre frequency within the interval of 2.3 to 2.7 GHz.

5. A reflector according to claim 1, wherein said first reflector assembly and said at least one second reflector assembly further are mechanically connected to each other.

6. A reflector according to claim 5, wherein said first reflector assembly and said at least one second reflector assembly are electrically and mechanically connected by means of a pair of support brackets.

7. A reflector according to claim 6, wherein said first reflector assembly and said at least one second reflector assembly has an elongated shape, and said pair of support brackets are connected to and extend along each opposite side of said first reflector assembly and said at least one second reflector assembly, respectively.

8. A reflector according to claim 5, wherein said first reflector assembly and said at least one second reflector assembly has substantially the same width.

9. A reflector according to claim 5, wherein said first reflector assembly and said at least one second reflector assembly are substantially U-shaped in cross-section.

10. A reflector according to claim 7, wherein said pair of support brackets are L-shaped.

11. A reflector according to claim 6, further comprising at least one connecting element for electrically and mechanically connecting said pair of support brackets so as to improve mechanical stiffness of said common reflector structure.

12. A reflector according to claim 11, wherein said at least one connecting element is arranged on a backside of said common reflector structure and mechanically connects said pair of support brackets.

13. A reflector according to claim 11, wherein said at least one connecting element is cross-shaped and comprises one or more recesses.

14. A reflector according to claim 5, wherein said first reflector assembly and said at least one second reflector assembly are electrically and mechanically connected by means of at least one connector plate arranged on a backside and/or a front side of said common reflector structure.

15. A reflector according to claim 1, wherein said first reflector assembly and said at least one second reflector assembly comprises at least one pair of symmetrically arranged current traps each.

16. A reflector according to claim 1, wherein:

said first reflector assembly comprises at least one first pair of reflector elements arranged so as to control the beam pattern of said at least one second antenna frequency band $f_2$; and said at least one second reflector assembly comprises at least one second pair of reflector elements arranged so as to control the beam pattern of said at least one third antenna frequency band $f_3$.

17. A reflector according to claim 1, wherein said first reflector assembly and said at least one second reflector assembly have different shapes.

18. A multi band antenna comprising at least one reflector, said reflector comprising a first reflector assembly and at least one second reflector assembly, said first reflector assembly having a first reflector structure adapted for a first antenna frequency band $f_1$ and at least one second antenna frequency band $f_2$;

said at least one second reflector assembly having a second reflector structure adapted for said first antenna frequency band $f_1$ and at least one third antenna frequency band $f_3$; and wherein said first reflector assembly and said at least one second reflector assembly are electrically coupled so that said first reflector assembly and said at least one second reflector assembly together form a common reflector structure adapted for said first $f_1$, at least one second $f_2$ and at least one third $f_3$ antenna frequency bands.

19. A multi band antenna according to claim 18, wherein said multi band antenna is arranged for use in a base station for wireless communication systems.

20. A multi band antenna according to claim 18, further comprising:

a plurality of first dual band antenna elements adapted for transmitting/receiving in at least said first $f_1$ and third antenna frequency bands $f_3$, a plurality of first single band antenna elements adapted for transmitting/receiving in said third antenna frequency band $f_3$, wherein said first dual band antenna elements and said first single band antenna elements are associated with said first reflector assembly;

a plurality of second dual band antenna elements adapted for transmitting/receiving in at least said first $f_1$ and second antenna frequency bands $f_2$, a plurality of second single band antenna elements adapted for transmitting/receiving in said second antenna frequency band $f_2$, wherein said second dual band antenna elements and said second single band antenna elements are associated with said second reflector assembly.

21. A multi band antenna according to claim 20, wherein at least two first single band antenna elements are arranged adjacent to each other.

22. A multi band antenna according to claim 20, wherein said at least two first single band antenna elements are arranged between two first dual band antenna elements.

23. A multi band antenna according to claim 22, wherein the distance $d_2$ between the centres of said at least two first single band antenna elements is more than half the wavelength for the centre frequency of said at least one third antenna frequency band $f_3$, and preferably between 0.6-0.9 times the wavelength for the centre frequency of said at least one third antenna frequency band $f_3$.

24. A multi band antenna according to claim 22, wherein the distance $d_2$ between the centres of said at least two first single band antenna elements is 0.6-0.8 times the wavelength for the centre frequency of said at least one third antenna frequency band $f_3$ and the distance between dual band antenna elements and single band antenna elements is 0.8-1.0 times the wavelength for the centre frequency of said at least one third antenna frequency band $f_3$.

25. A multi band antenna according to claim 18, wherein a centre frequency for said third antenna band frequency $f_3$ is more than 2 times higher than a centre frequency for said first antenna band frequency $f_1$.

26. A multi band antenna according to claim 25, wherein said first $f_1$ and third antenna frequency bands $f_3$ do not overlap, and wherein said centre frequency for said first $f_1$ and third antenna frequency bands $f_3$ are within the interval of:

790 to 960 MHz and 2.3 to 2.7 GHz;

698 to 894 MHz and 2.3 to 2.7 GHz;

698 to 894 MHz and 3.6 to 3.8 GHz; or 790 to 960 MHz and 3.6 to 3.8 GHz, respectively.

27. A multi band antenna according to claim 20, wherein said first dual band antenna elements and said first single band antenna elements are arranged in a row.

28. A multi band antenna according to claim 20, wherein said second dual band antenna elements and said second single band antenna elements are arranged in a row.

29. A multi band antenna according to claim 28, wherein said second dual band antenna elements and said second single band antenna elements are alternately arranged.

30. A multi band antenna according to claim 20, wherein said second antenna frequency band $f_2$ does not overlap with said first $f_1$ and third antenna frequency bands $f_3$; and wherein the centre frequency for said second antenna frequency bands $f_2$ is within the interval of 1710 to 2170 MHz.

31. A multi band antenna according to claim 20, wherein said antenna elements are patch antenna elements or dipoles.

* * * * *